US012780474B2

(12) United States Patent
Thingelstad

(10) Patent No.: US 12,780,474 B2
(45) Date of Patent: Nov. 3, 2026

(54) HOT-AIR EXTRACTION DUCT

(71) Applicants: Elopak ASA, Spikkestad (NO); Shikoku Kakoki Co., Ltd., Tokushima (JP)

(72) Inventor: Lars Aksel Thingelstad, Drammen (NO)

(73) Assignees: Elopak AS and Shikoku Kakoki Co., Ltd., Spikkestad (NO); Shikoku Kakoki Co., Ltd., Tokushima (JP)

( * ) Notice: Subject to any disclaimer, the term of this patent is extended or adjusted under 35 U.S.C. 154(b) by 393 days.

(21) Appl. No.: 18/565,540

(22) PCT Filed: Jun. 3, 2022

(86) PCT No.: PCT/EP2022/065236
§ 371 (c)(1),
(2) Date: Nov. 30, 2023

(87) PCT Pub. No.: WO2022/254028
PCT Pub. Date: Dec. 8, 2022

(65) Prior Publication Data

US 2024/0239540 A1 Jul. 18, 2024

(30) Foreign Application Priority Data

Jun. 4, 2021 (NO) ..... 20210716

(51) Int. Cl.
*B65B 55/00* (2006.01)
*B65B 55/02* (2006.01)
*B65B 55/10* (2006.01)

(52) U.S. Cl.
CPC ..... *B65B 55/025* (2013.01); *B65B 55/10* (2013.01); *B65B 2210/06* (2013.01)

(58) Field of Classification Search
CPC .... B65B 55/025; B65B 55/10; B65B 2210/06
(Continued)

(56) References Cited

U.S. PATENT DOCUMENTS 4,734,268 A 3/1988 Reddignton et al.
5,022,165 A * 6/1991 Beswick ..... B65B 55/10 422/115

(Continued)

FOREIGN PATENT DOCUMENTS

EP 0375166 A 6/1990
EP 2279952 2/2011

(Continued)

OTHER PUBLICATIONS

Microfilm of Japanese Utility Model Application No. 59-94087 (Japanese Laid-open Utility Model Publication No. 61-8505.

(Continued)

*Primary Examiner* — Jacob A Smith
(74) *Attorney, Agent, or Firm* — Christian D. Abel

(57) ABSTRACT

The present invention relates to a filling machine and a method handling hot air supplied at a station within the filling machine. The filling machine provides a working chamber with a clean zone for filling containers while the containers are conveyed through the working chamber. The clean zone is provided by introducing HEPA-filtered air into the working chamber through fluid inlets.

12 Claims, 7 Drawing Sheets

(58) Field of Classification Search
USPC ..... 53/425
See application file for complete search history.

(56) References Cited

U.S. PATENT DOCUMENTS

| | | | | |
|---|---|---|---|---|
| 6,120,730 | A * | 9/2000 | Palaniappan | B65B 55/10 53/167 |
| 6,383,449 | B1 * | 5/2002 | Pennekamp | B65B 55/025 422/1 |
| 8,944,079 | B2 * | 2/2015 | Auer | B65B 55/10 53/425 |
| 2012/0085370 | A1 * | 4/2012 | Auer | B65B 55/025 134/61 |

FOREIGN PATENT DOCUMENTS

| | | |
|---|---|---|
| EP | 3230169 | 10/2017 |
| JP | 61-8505 | 1/1986 |
| JP | 8-152171 | 6/1996 |
| JP | 2517271 | 7/1996 |
| WO | WO 2004/054883 | 7/2004 |
| WO | WO 2017/035448 Y | 3/2017 |

OTHER PUBLICATIONS

Microfilm of Japanese Utility Model Application No. 63-133218 (Japanese Laid-open Utility Model Publication No. 2-55045).
Office Action from Japanese Patent Office dated Sep. 25, 2025 in JP2023-574154, submitted inter alia as a Statement of Relevance for any non-English refs cited therein.
ISRWO in PCT/EP2022/065236.
Norwegian Search Report in NO20210716.
Office Action of Apr. 23, 2026 in CN202280039857.7, submitted inter alia as a statement of relevance for any non-English references cited therein.

* cited by examiner

HOT-AIR EXTRACTION DUCT

TECHNICAL FIELD

The present invention relates to a filling machine for filling product into containers, in particular liquid foodstuffs, while the containers are being conveyed through a working chamber in an clean atmosphere and where the containers are acted upon by hot air before being sealed and means for handling the hot air without disrupting the clean atmosphere, and a method for use thereof.

BACKGROUND AND PRIOR ART

When filling liquid foodstuff into containers it has proven expedient to use a filling machine where containers are conveyed on a conveyor from an inlet side to an outlet side of a working chamber. While the containers are conveyed they are, starting at the inlet side, treated with a cleaning agent or sterilized for example by being acted upon by ultraviolet light. The containers then enter a filling region in the working chamber where the liquid foodstuff is filled into the containers. The containers are then conveyed to a closing region within the working chamber. The filling region and the closing region within the working chamber are typically separated by a wall running transversely to the conveying path. The containers are closed in the closing region which comprises a heating station and a sealing station. The heating station supplies hot air to the top of the container and the sealing station folds and presses the open container in order to close and seal the container by forming a gable.

It is necessary to maintain a clean atmosphere in the working chamber above the open containers in order to obtain filled containers without contamination from particles, bacteria or viruses which would severely compromise the quality and the shelf life of the food product in the filled containers. The clean atmosphere is typically obtained by supplying the working chamber with a fluid such as HEPA-filtered air, aimed at the containers from fluid inlet openings above the containers. To maintain a clean atmosphere, it is important that the HEPA-air has a uniform flow without turbulence at least above the conveyer inside the working chamber where the containers are open.

The hot air supplied at the heating station has a higher flow velocity, a higher temperature and a higher flow rate than the HEPA-air and is therefore a source of turbulence and disturbance in the area where a clean atmosphere is necessary. There is therefore a need for handling the hot air supplied by a heating station in a filling machine.

In one commercially available filling machine HEPA-air is provided to the working chamber via a plenum with a plurality of through holes located in the ceiling of the working chamber. This arrangement may cause challenges with turbulence and backflow causing the flow of HEPA-air to be inconsistent around the conveyor and the top of the containers. Furthermore, there is no mention of measures taken to avoid that a hot air supply at a heating station in this filling machine affects the uniform flow of HEPA-air.

A filling machine known from U.S. Pat. No. 8,944,079 B2 comprises a working chamber for filling product into containers having an external line for introducing sterile fluid into the working chamber. The external line extends through the working chamber and has openings disposed over the containers for uniformly spreading sterile fluid over the containers which are disposed underneath the external line. This external line surrounds an internal line which is configured to dispense a cleaning medium from nozzles. The internal line rotates within the external line to properly clean the inside of the external line. The containers are cleaned with hydrogen peroxide prior to filling. This filling machine may have exhaust pipes located below the filling line of the containers for preventing escape of hydrogen peroxide from the working chamber. An exhaust device near the floor can also draw sterile fluid from the working chamber. This configuration has challenges with backflow of un-sterile hot air from the pre-heater and the mass flow of sterile air in the working chamber was not suitable in all operating conditions to maintain a clean atmosphere. The document is silent about handling of hot air from a heating station.

EP3230169 B1 provides a filling machine much like the one described in U.S. Pat. No. 8,944,079 B2, but wherein the sterile atmosphere in the working chamber is improved. The annular chamber between the internal line and the external line is configured such that the cross-sectional area is gradually reduced down to virtually zero. This provides a constant static pressure over the length of the annular chamber which results in a uniform flow of clean fluid over the length of the filling region. This configuration still has problematic regions with back-flows and turbulence. This is solved by adding flow bodies for managing the flow resistance in the working chamber. The cleaning procedure requires the internal line to rotate within the external line while dispensing a cleaning medium. The document is silent with regards to handling hot air from a heating station.

It is thus an object of the present invention to provide a filling machine for filling product into containers in a clean zone which at least mitigates the above-mentioned disadvantages of the prior art.

More particular, it is an object of the present invention to provide a filling machine with means for handling hot air which is supplied to the working chamber of a filling machine in relation to the closing and sealing of containers.

Also, it is an object of the present invention to provide a method for handling hot air supplied in such a filling machine.

SUMMARY OF THE INVENTION

The present invention is set forth and characterized in the main claims, while the dependent claims describe other characteristics of the invention.

In one aspect the present invention concerns a filling machine comprising a working chamber which comprises side walls, a ceiling and a floor, wherein containers comprising container top ends facing the ceiling, and container bottom ends facing the floor are conveyed through the working chamber by a conveyer, from an inlet side to an outlet side, wherein the working chamber comprises a station within the working chamber configured to execute a working step on the containers, wherein the station comprises a hot air supply for executing a work step on the containers, and where the working chamber further comprises an extraction duct for extracting hot air supplied by the hot air supply to the outside of the working chamber.

In one configuration of the filling machine the extraction duct is located at a vertical level below the container top ends, when the containers are conveyed. The extraction duct may for example be located directly below the station comprising the hot air supply.

In one configuration of the filling machine the filling machine further comprises a fan configured for extracting the hot air through the extraction duct. The fan may be located within the extraction duct.

In one configuration of the filling machine the fan is configured with speed control for balancing the volume of hot air extracted through the extraction duct with the volume of hot air supplied via the hot air supply. The fan may, if needed, extract a larger or smaller volume of air from the working chamber than the volume of hot air introduced via the hot air supply.

In one configuration of the filling machine the working chamber comprises a heating station, wherein the heating station comprises at least one hot air nozzle for directing hot air at the container top ends, and at least one heating station deflector configured for guiding the hot air towards the extraction duct. The heating station deflector may have a bend for guiding hot air flow down towards the floor.

In one configuration of the filling machine the working chamber comprises a side deflector arranged between the side wall and the heating station on side of the working chamber opposite to the extraction duct, and wherein the side deflector is configured to guide the hot air towards the extraction duct. The side deflector may comprise a bend proximal and/or distal to the floor for guiding hot air flow.

In one configuration of the filling machine the side deflector comprises guiding plates protruding towards the conveyor, wherein hot air supply is configured to supply hot air between the side deflector and the guiding plates for guiding the hot air towards the extraction duct.

In one configuration the filling machine comprises at least one fluid inlet, wherein said at least one fluid inlet comprises a convex fluid inlet surface facing the working chamber and displaying a plurality of through openings configured to supply the working chamber with a fluid for creating a clean zone around at least one station, and wherein said at least one fluid inlet is fluidly connected to a supply conduit for supplying the fluid to the working chamber.

In one configuration of the filling machine the working chamber is divided into a filling region and a closing region by a wall extending transversely within the working chamber, wherein the filling region is proximal to the inlet side and the closing region is proximal to the outlet side.

In one configuration of the filling machine the filling region comprises a at least one fluid inlet and the closing region comprises at least one fluid inlet.

In a second aspect the present invention concerns a method for handling hot air in a filling machine comprising the steps of:

A. Providing a filling machine comprising:
  a working chamber comprising side walls, a ceiling and a floor, wherein containers comprising
  container top ends facing the ceiling, and
  container bottom ends facing the floor are conveyed through the working chamber by a conveyer, from an inlet side to an outlet side, wherein the working chamber comprises
  a station within the working chamber configured to execute a working step on the containers, wherein
  the station comprises a hot air supply for executing a work step on the containers, wherein the working chamber further comprises an extraction duct for extracting hot air supplied by the hot air supply to the outside of the working chamber.

B. extracting said hot air supplied by the hot air supply by using the extraction duct.

The filling machine may be in accordance with any of the characteristics described above under the first aspect of the invention.

In order to handle the hot air within the filling machine, the following steps may be performed:

C. providing the filling machine according to the characteristics described above, wherein the filling machine comprises a fan configured for extracting the hot air through the extraction duct, D. operating the fan for extracting hot air from the working chamber through the extraction duct to the outside.

For further control with regards to the handling of hot air within the filling machine the following steps may be performed:

E. providing the filling machine according to the characteristics described above, wherein the fan is configured with a speed control, F. controlling the speed to the fan for balancing the volume of hot air extracted through the extraction duct with the volume of hot air supplied via the hot air supply by operating the speed control.

DETAILED DESCRIPTION OF THE INVENTION

In the following, specific embodiments of the invention will be described in more detail with reference to the drawings. However, the invention is not limited to the embodiments and illustrations contained herein. It is specifically intended that the invention includes modified forms of the embodiments, including portions of the embodiments and combinations of elements of different embodiments. It should be appreciated that in the development of any actual implementation, as in any engineering or design project, specific decisions must be made to achieve the developer's specific goals, such as compliance with system and/or business-related constraints. Moreover, it should be appreciated that such a development effort might be complex and time consuming, but would nevertheless be a routine undertaking of design, fabrication and manufacture for the skilled person having the benefit of this disclosure.

Figure 1:
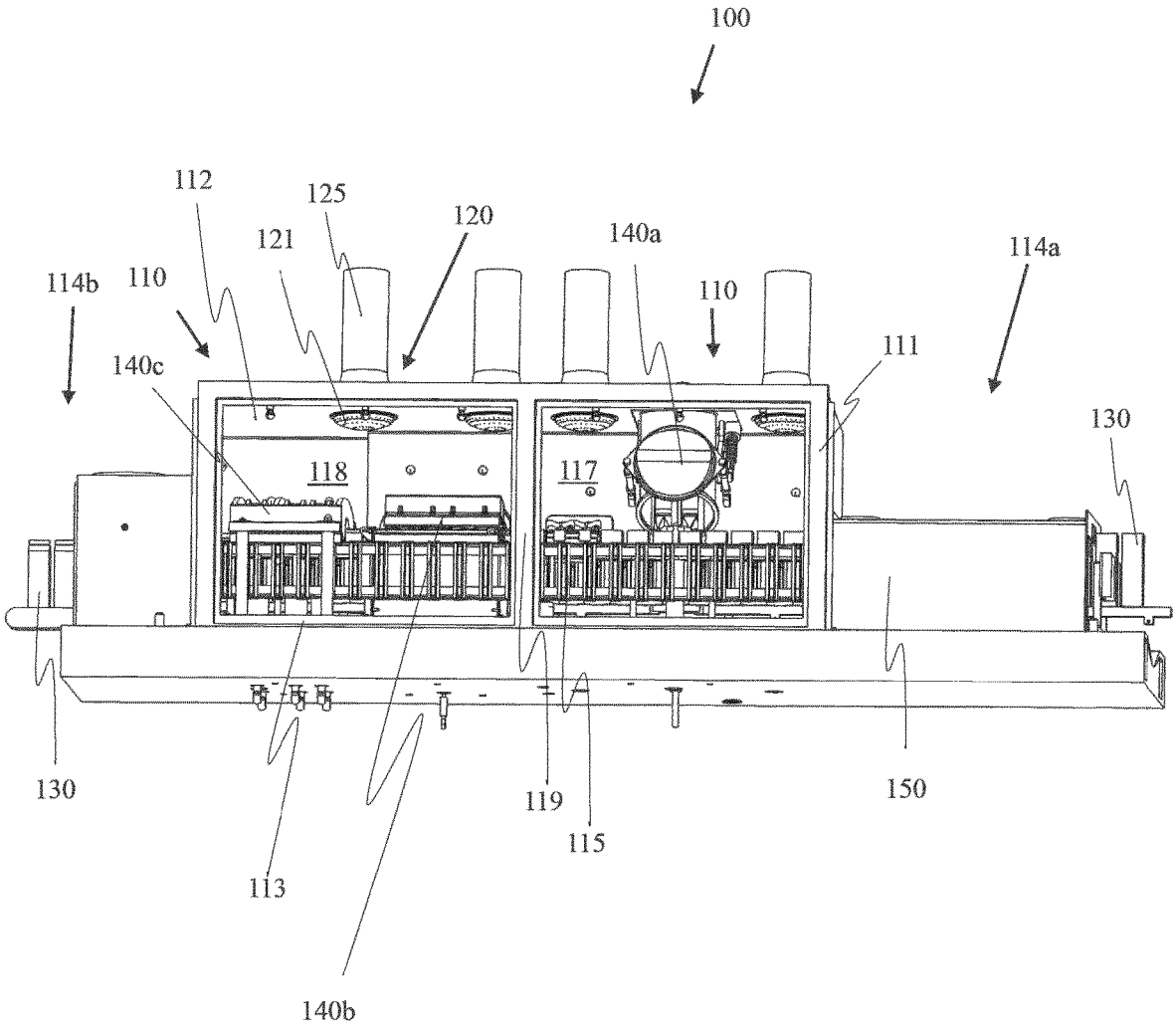
FIG. 1 Illustrates a frontal view of the filling machine having a working chamber with containers on a conveyor, a filing region, closing region with a heating station comprising a hot air supply. 20
Figure 2:
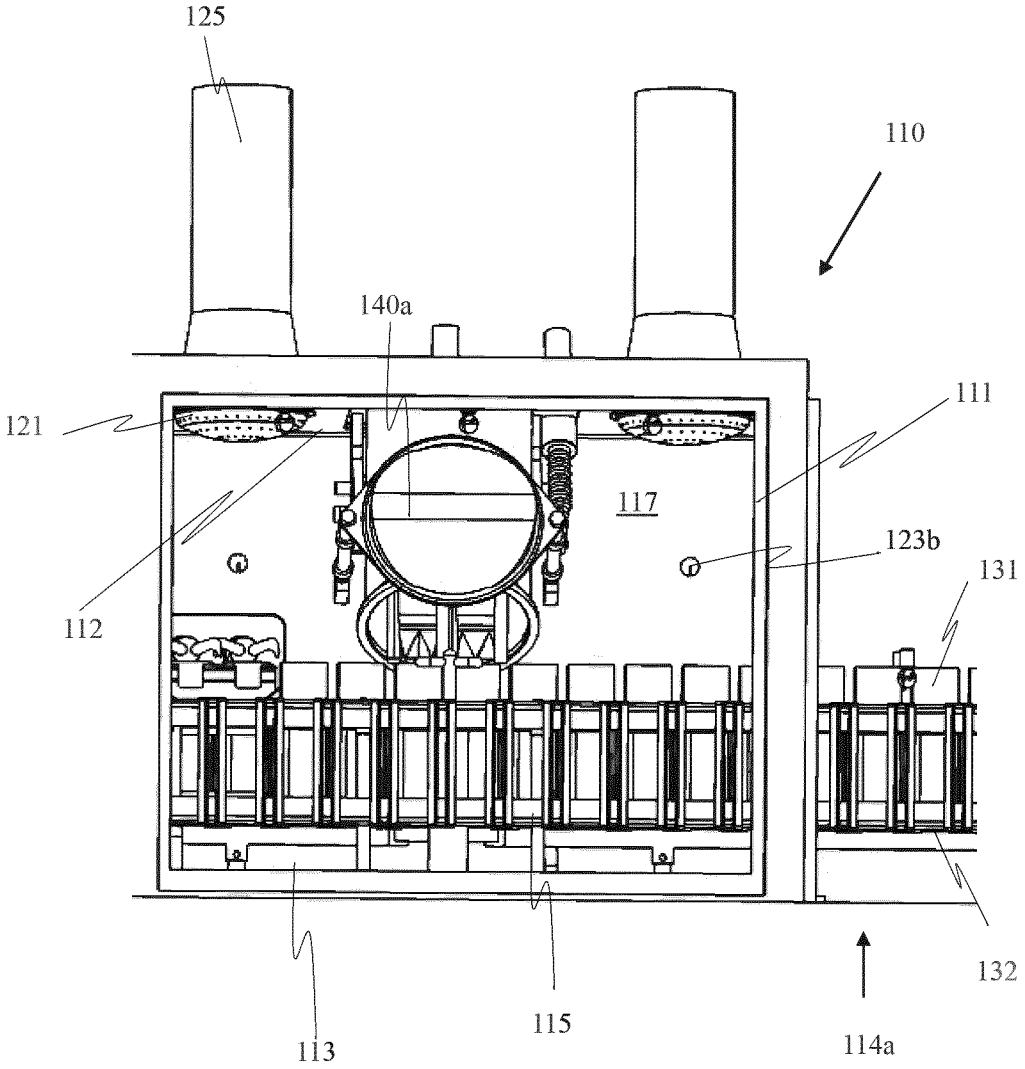
FIG. 2 Shows details of the filling region with a filling station.
Figure 3:
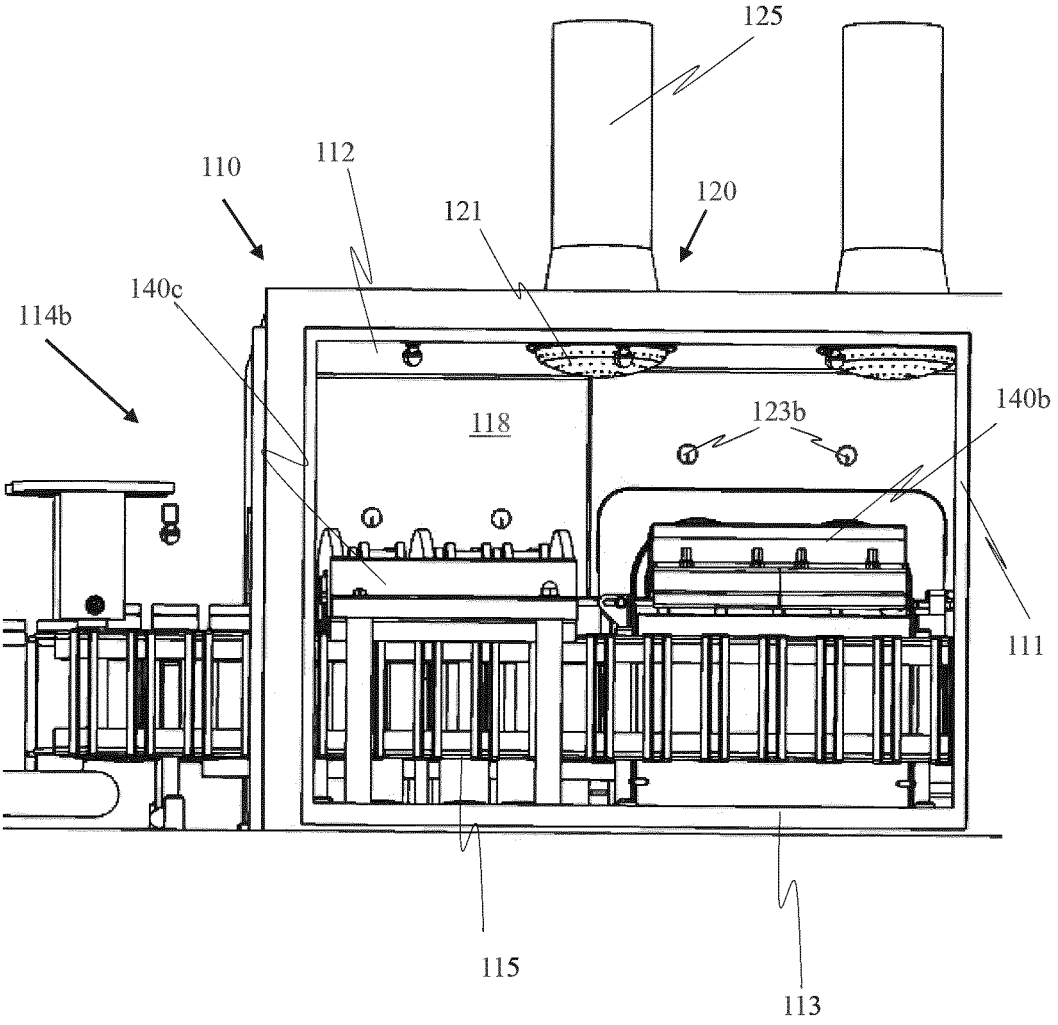
FIG. 3 Shows a side view of the closing region with a pre-heating station and a closing station.

With reference to FIGS. 1-3, the filling machine 100 as shown, includes a working chamber 110 suitable for providing a clean atmosphere. The working chamber 110 is defined by side walls 111, a ceiling 112 and a floor 113. The working chamber 110 has a hollow cuboid shape. The working chamber 110 comprises a conveyer 115 which is configured to convey containers 130 from an inlet side 114*a* to an outlet side 114*b* of the working chamber 110. The working chamber 110 has a longitudinal direction from the inlet side 114*a* to the outlet side 114*b*. The containers 130 are designed to hold liquid foodstuff such as a beverage.

Proceeding from the inlet side 114*a* to the outlet side 114*b*, the working chamber 110 is divided into a filling region 117 and a closing region 118 by a wall 119. The wall 119 extends transversely to the longitudinal direction of the working chamber 110.

The filling region 117 is located proximal to the inlet side 114*a* and the closing region 118 is located proximal to the outlet side 114*b*.

The filling machine 100 comprises a decontamination tunnel 150 located outside the working chamber 110 in connection with the inlet side 114*a*. Prior to entering the filling region 117 the containers 130 is conveyed by the conveyor 115 through the decontamination tunnel 150 and subjected to decontamination therein. The decontamination includes exposure of the containers 130 to UV-light.

The containers 130 enters the working chamber 110 by means of the conveyor 115 in an open state. The filling of liquid foodstuff into the containers 130 takes place in the filling region 117 by means of a filling station 140*a* located in the filing region. Still in an open state, the filled containers 130 are conveyed into the closing region 118 where the container top ends 131 are heated by means of a heating station 140*b*.

The containers 130 are then conveyed to a sealing station 140*c* located in the closing region 118. The containers 130 are closed and sealed by the sealing station 140*c* which forms a gable by folding of the container top ends 131. Finally, the containers 130 exit the working chamber 110 through the side wall 111 at the outlet side 114*b* by means of the conveyer 115.

It is necessary to maintain a clean atmosphere in the working chamber 110, in particular above the open containers 130 in order to obtain filled containers 130 without contamination from particles, bacteria or viruses which would severely compromise the quality and the shelf life of the liquid food product in the filled containers 130. The clean atmosphere is obtained by supplying the working chamber 110 with HEPA-air.

As used herein the term HEPA-air relates to air that is filtered through a HEPA filter. A HEPA-filter is a high efficiency particulate air filter. HEPA filters, as defined by the United States Department of Energy (DOE) standard adopted by most American industries, remove at least 99.97% of aerosols 0.3 micrometers (μm) in diameter. HEPA filters capture pollen, dirt, dust, moisture, bacteria (0.2-2.0 μm), virus (0.02-0.3 μm). Per definition HEPA-air is suitable for creating a clean zone when introduced into a working chamber.

The working chamber 110 comprises a plurality of fluid inlets 120. Each of the said fluid inlets 120 comprises a convex fluid inlet surface 121 that faces the working chamber 110. Each of the fluid inlet surface 121 is located at the ceiling 112 and displays a plurality of through openings 122. Each of the fluid inlets 120 is fluidly connected to a supply conduit 125 which supplies HEPA-air to each respective fluid inlet 120. The HEPA-air is introduced to the working chamber through the through openings 122.

The through openings 122 are configured to aim a continuous laminar and uniform flow of HEPA-air from the fluid inlet surface 121 at least down to below the vertical level of the container top ends 131 when the containers 130 are being conveyed. The laminar and uniform HEPA-air flow provides a clean zone that extends from the fluid inlet surfaces 121 to belove the vertical level of the container top ends 131 when the containers 130 are being conveyed, throughout the working chamber 110, and thereby prevents any contaminants from entering into the containers 130 while being conveyed through the working chamber 110. The working chamber is configured with cleaning nozzles 123*b* for cleaning the surfaces within the working chamber 110.

Figure 4:
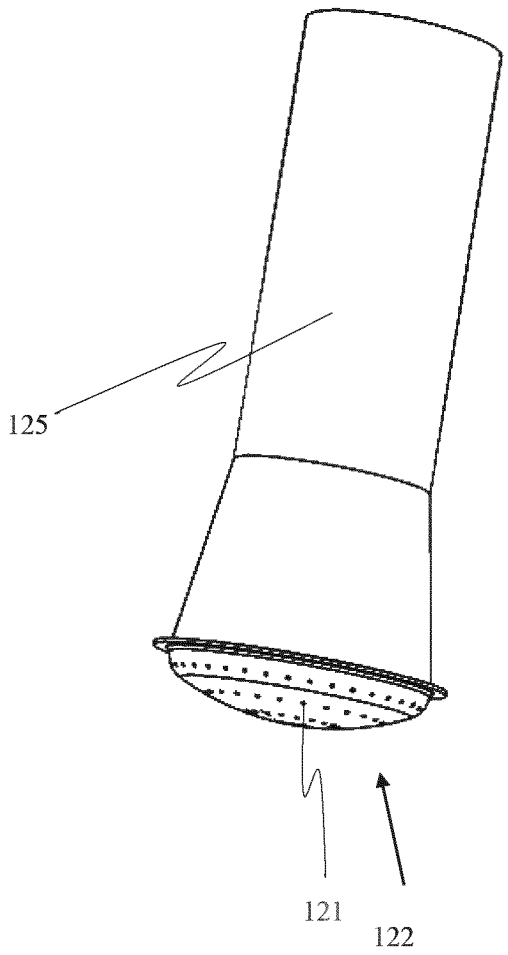
FIG. 4 shows an isolated supply conduit with a convex fluid inlet surface and a plurality of openings. 25

As shown in FIG. 4 the fluid inlet surface 121 has a convex ellipsoidal shape facing the working chamber 110, where the radius of the curvature of the fluid inlet surface 121 is greater distal from the ceiling 112 than the radius of the curvature of the fluid inlet surface 121 proximal to the ceiling 112. Said ellipsoidal shape of the fluid inlet aids in equalizing the pressure of the HEPA-air over the through openings 122. Said ellipsoidal shape also provides a surface suitable for the through openings 122 produce a laminar and uniform HEPA-air flow to be aimed directly at the container top ends 131 while they are conveyed in the working chamber.

To further aid the provision of a uniform and laminar HEPA-air flow in the working chamber 110 the pressure of the HEPA-air is equalized over the through openings 122. The supply conduit 125 has the shape of a circular pipe with a cross section that is suitable for providing a slow HEPA-air flow velocity. The cross section of the supply conduit 125 increases towards the end proximal to the fluid inlet surface 121. This further slows the HEPA-air flow velocity and aids in equalizing the pressure of the HEPA-air over the through openings 122, which in turn provides a uniform and laminar HEPA-air flow. When the pressure of the HEPA-air is equalized over the plurality of through openings 122 the risk of undesired backflow of air from the working chamber 110, which may lead to contamination is reduced.

The configuration of the filling machine 100 with the supply conduits 125 allows for a more compact design than when using one plenum for equalizing pressure over the through openings 122. This is due to that a plenum needs to have a much larger volume for slowing the HEPA-air flow velocity than what is needed when using the supply conduits 125 as describe herein.

Figure 5:
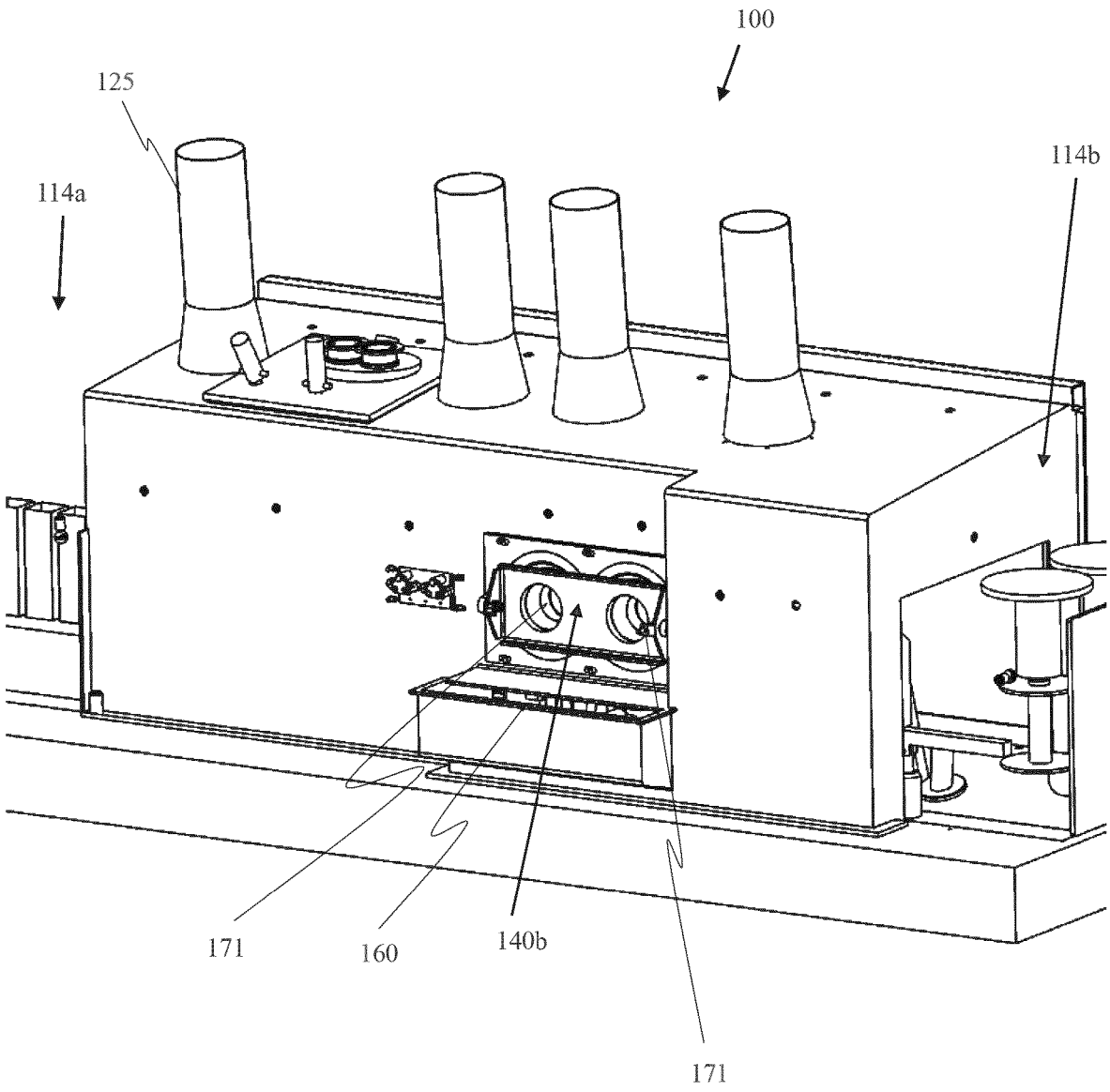
FIG. 5 Shows a rear view of the filling machine with hot air supplies to the heating station and an extraction duct located below the heating station.
Figure 6:
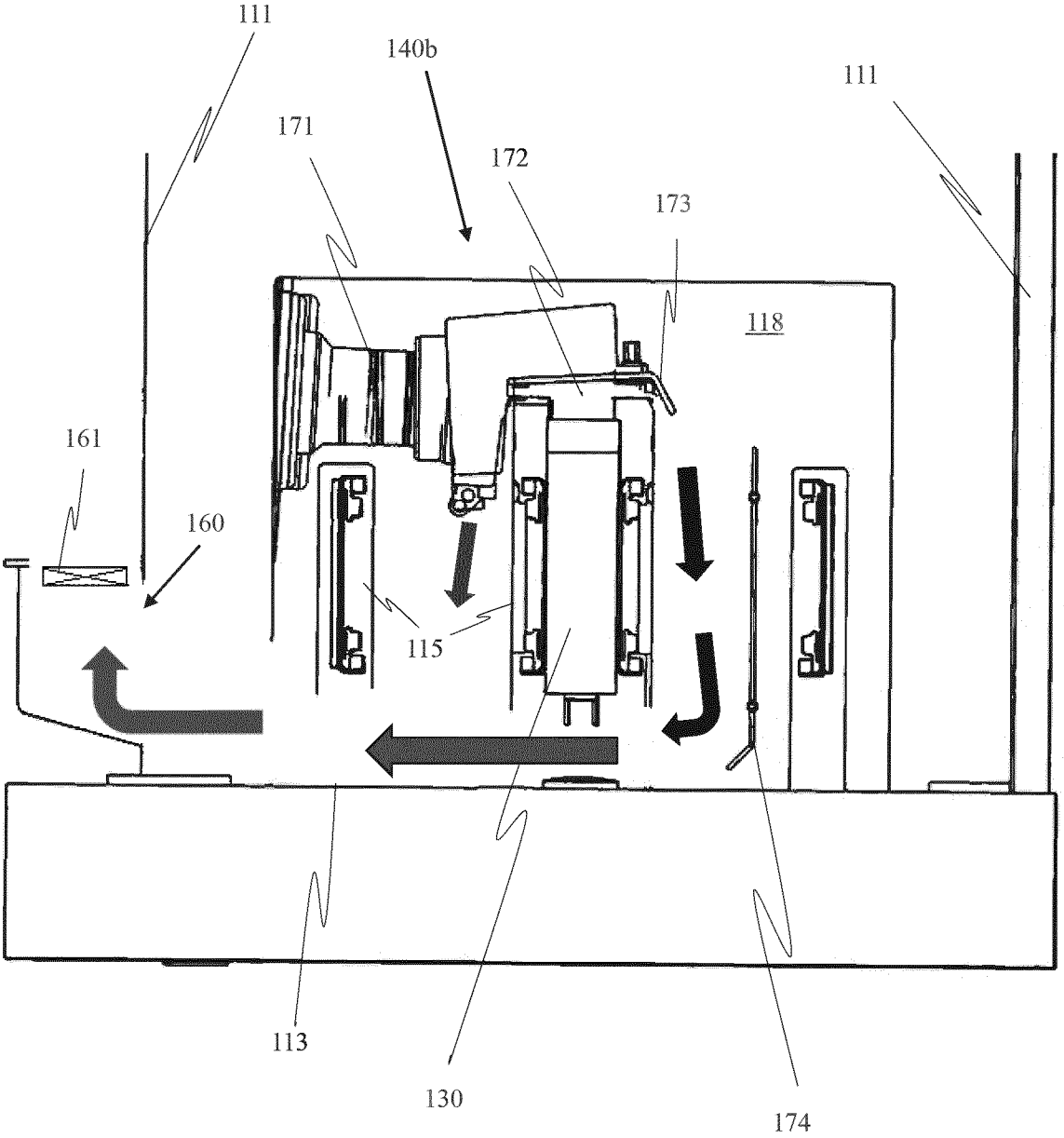
FIG. 6 Shows a cross-sectional side view of the heating station, the hot air supply, the heating station deflector and the side deflector. It is also shown containers on the conveyer and the arrows represents the flow of hot air from hot air nozzles towards the extraction duct to the outside of the working chamber. A suction fan is shown in the extraction duct.

As shown in FIGS. 5-6 the filling machine includes an extraction duct 160 that is located directly belove the heating station 140*b*. The heating station 140*b* comprises a hot air supply 171 that directs hot air at the containers 130 by means of a hot air nozzle 172. The hot air is used for preparing the containers 130 for closing and scaling at the sealing station 140*c*.

Introduction of hot air into the working chamber 110 represents a risk for disrupting the laminar flow of HEPA-air. The hot air supplied has a higher flow velocity and a higher temperature than the HEPA-air. Turbulence and mixing of air in the clean zone with air from potentially unclean zones inside the working chamber are avoided by means of the extraction duct 160 which is configured for extraction of hot air supplied by the hot air supply 171.

The extraction duct 160 is a duct that allows the hot air to be extracted from the inside of the working chamber 110 to the outside ambient air.

The filling machine 100 comprises a fan 161 disposed within the extraction duct 160. The fan 161 is a suction fan that is configured to suck air from within the working chamber 110, through the extraction duct 160 to the outside ambient air.

The fan 161 is fitted with a speed control that enables variation of the speed of the fan and thus, variation of the volume of air that the fan 161 sucks from the working chamber 110.

The hot air supply 171 is configured to supply a variable volume of hot air to the heating station 140*b* via the hot air nozzle 172.

The speed of the fan 161 is regulated by means of the speed control to balance the volume of air extracted through the extraction duct 160 with the volume of hot air supplied by the hot air supply 171. In this manner the hot air supplied at the heating station 140*b* will have minimal impact on the laminar flow of HEPA-air in the clean zone within the working chamber 110, in particular within the closing region 118.

The heating station 140*b* comprises a heating station deflector 173 located adjacent to the hot air nozzle 172. The heating station deflector 173 has a bend for directing the hot air coming from the hot air nozzle 172 down towards the floor 113.

A side deflector 174 is arranged between the heating station 140*b* and the side wall 111 on the side of the working chamber 110 that is opposite to the extraction duct 160. The side deflector 174 extends vertically from the level of the container top ends 131 when they are conveyed and down towards the floor 113. The side deflector 174 comprises a comprises bend proximal to the floor 113 for directing the hot air towards the extraction duct 160.

The black arrows in FIG. 6 illustrates the direction of flow for the hot air from the hot air nozzle 172, via the heating station deflector 173 and the side deflector 174 towards the extraction duct 160.

Figure 7:
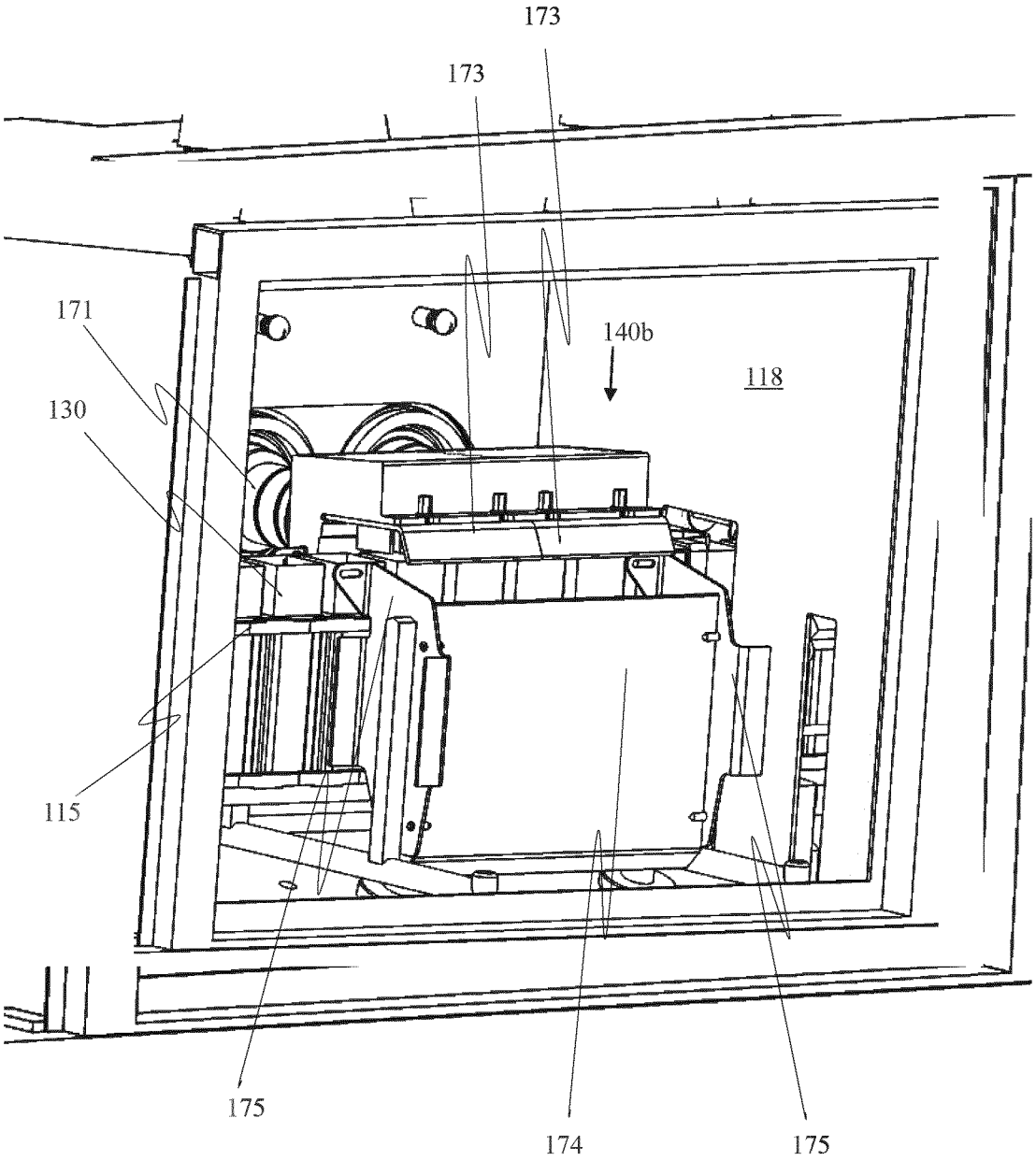
FIG. 7 shows a front view of the closing region with the heating station and the side deflector with guiding plates arranged facing the conveyor at the side of the side deflector.

As shown in FIG. 7 the filling machine further comprises guiding plates 175 that extends from each vertical side of the side deflector 174 towards the conveyor 115 and the heating station 140*b*. Together, the side deflector 174 and the guiding plates 175 forms channel within the closing region 118 which is suitable for guiding hot air towards the floor 113, towards the extraction duct 160 and subsequently to the outside ambient air.

It is appreciated that certain features of the invention, which, for clarity, have been described above in the context of separate configurations, may also be provided in combination in a single configuration. Conversely, various features of the invention, which, for brevity, have been described in the context of a single configuration, may also be provided separately or in any suitable sub-combination.

| List of references: | |
|---|---|
| 100 | Filling machine |
| 110 | Working chamber |
| 111 | Side walls |
| 112 | Ceiling |
| 113 | Floor |
| 114a | Inlet side |
| 114b | Outlet side |
| 115 | Conveyor |
| 117 | Filling region |
| 118 | Closing region |
| 119 | Wall |
| 120 | Fluid inlet |
| 121 | Fluid inlet surface |
| 122 | Through openings |
| 123b | Working chamber cleaning nozzle |

-continued

| List of references: | |
|---|---|
| 125 | Supply conduit |
| 130 | Container |
| 131 | Container top end |
| 132 | Container bottom end |
| 140a | Filling station |
| 140b | Heating station |
| 140c | Sealing station |
| 150 | Decontamination tunnel |
| 160 | Extraction duct |
| 161 | Fan |
| 171 | Hot air supply |
| 172 | Hot air nozzle |
| 173 | Heating station deflector |
| 174 | Side deflector |
| 175 | Guiding plates |

The invention claimed is:

1. A filling machine comprising a working chamber comprising side walls, a ceiling and a floor, wherein containers comprising container top ends facing the ceiling, and container bottom ends facing the floor are conveyed through the working chamber by a conveyer, from an inlet side to an outlet side, wherein the working chamber comprises a station within the working chamber configured to execute a working step on the containers, wherein the station comprises a hot air supply for executing the working step on the containers, wherein the working chamber further comprises an extraction duct for extracting hot air supplied by the hot air supply to the outside of the working chamber, and wherein the working chamber comprises a heating station, wherein the heating station comprises at least one hot air nozzle for directing hot air at the container top ends, and at least one heating station deflector configured for guiding the hot air towards the extraction duct.

2. The filling machine according to claim 1, wherein the extraction duct is located at a vertical level below the container top ends, when the containers are conveyed.

3. The filling machine according to claim 1, wherein the filling machine further comprises a fan configured for extracting the hot air through the extraction duct.

4. The filling machine according to claim 3, wherein the fan is configured with speed control for balancing the volume of hot air extracted through the extraction duct with the volume of hot air supplied via the hot air supply.

5. The filling machine according to claim 1, wherein the working chamber comprises a side deflector arranged between the side wall and the heating station on side of the working chamber opposite to the extraction duct, and wherein the side deflector is configured to guide the hot air towards the extraction duct.

6. The filling machine according to claim 5, wherein the side deflector comprises guiding plates protruding towards the conveyor, wherein hot air supply is configured to supply hot air between the side deflector and the guiding plates for guiding the hot air towards the extraction duct.

7. The filling machine according to claim 1 comprising at least one fluid inlet, wherein said at least one fluid inlet comprises a convex fluid inlet surface facing the working chamber and displaying a plurality of through openings configured to supply the working chamber with a fluid for creating a clean zone around at least one station, and wherein said at least one fluid inlet is fluidly connected to a supply conduit for supplying the fluid to the working chamber.

8. The filling machine according to claim 1, wherein the working chamber is divided into a filling region and a closing region by a wall extending transversely within the working chamber, wherein the filling region is proximal to the inlet side and the closing region is proximal to the outlet side.

9. The filling machine according to claim 8, wherein the filling region comprises an at least one fluid inlet, and wherein the closing region comprises at least one fluid inlet.

10. A method for handling hot air in a filling machine comprising the steps of:

A. Providing a filling machine comprising:

a working chamber comprising side walls, a ceiling and a floor, wherein containers comprising container top ends facing the ceiling, and container bottom ends facing the floor are conveyed through the working chamber by a conveyer, from an inlet side to an outlet side, wherein the working chamber comprises a station within the working chamber configured to execute a working step on the containers, wherein the station comprises a hot air supply for executing the working step on the containers, wherein the working chamber further comprises an extraction duct for extracting hot air supplied by the hot air supply to the outside of the working chamber, and B. extracting said hot air supplied by the hot air supply by using the extraction duct, wherein the working chamber comprises a heating station, wherein the heating station comprises at least one hot air nozzle for directing hot air at the container top ends, and at least one heating station deflector configured for guiding the hot air towards the extraction duct.

11. The method according to claim 10, wherein the method further comprises the steps of:

C. providing the filling machine according to claim 10, wherein the filling machine comprises a fan configured for extracting the hot air through the extraction duct, D. operating the fan for extracting hot air from the working chamber through the extraction duct to the outside.

12. The method according to claim 11, wherein the method further comprises the steps of:

E. providing the filling machine according to claim 11, wherein the fan is configured with a speed control, F. controlling the speed to the fan for balancing the volume of hot air extracted through the extraction duct with the volume of hot air supplied via the hot air supply by operating the speed control.

* * * * *